US005095642A

United States Patent [19]

George et al.

[11] Patent Number: 5,095,642

[45] Date of Patent: Mar. 17, 1992

[54] FOLDABLE SIGN

[75] Inventors: Gary P. George; Earl W. Karsten, both of St. Louis, Mo.

[73] Assignee: Stout Industries, Inc., St. Louis, Mo.

[21] Appl. No.: 659,872

[22] Filed: Feb. 25, 1991

[51] Int. Cl.[5] ..... G09F 15/00

[52] U.S. Cl. ..... 40/606; 40/610; 40/611

[58] Field of Search ..... 40/610, 612, 606; 248/164, 431, 166, 170, 188.6

[56] References Cited

U.S. PATENT DOCUMENTS

| | | | |
|---|---|---|---|
| 2,695,548 | 11/1954 | Silverman | 248/166 |
| 2,844,897 | 7/1958 | Vance, Jr. | 248/166 |
| 3,041,032 | 6/1962 | Wilcox | 248/170 |
| 3,080,139 | 3/1963 | Caprioli | 248/170 |
| 3,231,994 | 2/1966 | Cyrus | 248/166 |
| 4,005,537 | 2/1977 | von Comber et al. | 40/610 |
| 4,038,769 | 8/1977 | Werner | 40/610 |
| 4,169,571 | 10/1979 | Duggan | 248/166 |

FOREIGN PATENT DOCUMENTS

| | | | |
|---|---|---|---|
| 1107623 | 12/1952 | France | 248/166 |
| 1105497 | 12/1955 | France | 248/166 |
| 1181967 | 6/1959 | France | 40/612 |

*Primary Examiner*—Kenneth J. Dorner
*Assistant Examiner*—Cassandra Hope
*Attorney, Agent, or Firm*—Paul M. Denk

[57] ABSTRACT

Street signs are signs placed in store fronts or store aisles, at service stations, or the like, to display messages to the public. They generally include a sign panel supported by a base assembly and legs connected to the base assembly which support the sign. The present invention includes such a street sign having legs pivotally attached to the base assembly so that when the sign is to be stored, it may be conveniently folded so as to be made relatively narrow for convenience of carrying and storage.

2 Claims, 2 Drawing Sheets

FOLDABLE SIGN

BACKGROUND OF THE INVENTION

This invention relates to street signs, and in particular foldable street signs.

Street signs are often employed by shopkeepers to display messages in front of their stores or in aisles to display various messages to their customer. These street signs generally include a sign panel supported by a base assembly having legs. The legs, however are generally fixed. Thus, much space is required to store the street sign making the storage thereof inconvenient and expensive. Further, because the legs are fixed, it is difficult to pass the sign through doorways and other constricted areas.

Various types of prior art signs and their constructions, for use for display purposes, can be found in the prior art. For example, the patent to Capper, U.S. Pat. No. 2,467,187, discloses a weighted pivoted sign, which is designed primarily to provide for the pivotal movement of its sign portion, in order to accommodate wind gusts.

The patent to Sarkisian, U.S. Pat. No. 3,646,696, discloses a similar type of poster display device, which is spring mounted, for the purpose of providing means for reducing the effects of lateral forces that normally have a tendency to topple the display device.

Another U.S. Pat. No. 3,662,482 to Sarkisian, shows a related type of device.

U.S. Pat. No. 4,033,536, shows a further embodiment for a spring mounted display sign.

U.S. Pat. No. 4,265,040, shows a related type of development.

U.S. Pat. No. 4,288,053, discloses a spring mounted sign, with a quad-pod type of base.

U.S. Pat. No. 4,509,714, to Seely, discloses a type of portable wind-resistant sign stand with flexible bow-type legs.

U.S. Pat. No. 4,516,344, also to Seely, discloses a portable wind-resistant sign stand with flexible sign.

U.S. Pat. No. 4,783,921, which was obtained by one of the inventors herein, and assigned to a common assignee, discloses a mounting arrangement for wind-deflectible bending sign.

Finally, reissue U.S. Pat. No. Re. 32,359, to Seely, shows the portable wind-resistant sign stand with flexible sign.

SUMMARY OF THE INVENTION

One object of the present invention is to produce a sign which requires very little space to store;

Another object is to produce such a sign which is easy to transport.

Another object is to produce such a sign which is simple to manufacture.

A further object of this invention is to provide a sign, generally fabricated of metal or polymer components, and which is very easy to manipulate into closure, to facilitate its carriage, but in the alternative, can be easily folded into its erected condition, and exhibit significant stability to function as a display sign that may be exposed to a variety of detrimental conditions, such as inclement weather that may be encountered outdoors, such as rain, snow, and the wind.

These and other objects will become apparent to those skilled in the art in light of the following disclosure and accompanying drawings.

In accordance with the invention, generally stated, there is provided a foldable sign. The sign includes a sign panel, a base assembly which receives the sign panel and leg means pivotably connected to the base assembly. The leg means are pivotable between a first or open position wherein the legs engage the ground to support the sign and a second or folded position wherein the legs extend above the base assembly and generally contiguous with the sign. The leg means includes a front leg means and a back leg means. The front leg means are connected to a back side of said base assembly and the back leg means are connected to a front side of said base assembly. The front and back leg means cross beneath the base assembly when in the open and erected position.

The base assembly includes forwardly and rearwardly directed flanges to which the leg means are connected. Each leg means includes a left leg and a right leg pivotally connected to one of the flanges. The right and left legs are integrally connected by a cross bar at an end remote from the base assembly. One of the leg means passes through the other when the leg means are moved between the open and folded positions.

The base also includes an upwardly and outwardly directed lip. The leg means engage the lip when the sign is in the folded position to prevent any contact with or marring of the sign panel.

DESCRIPTION OF THE PREFERRED EMBODIMENT

Figure 1:
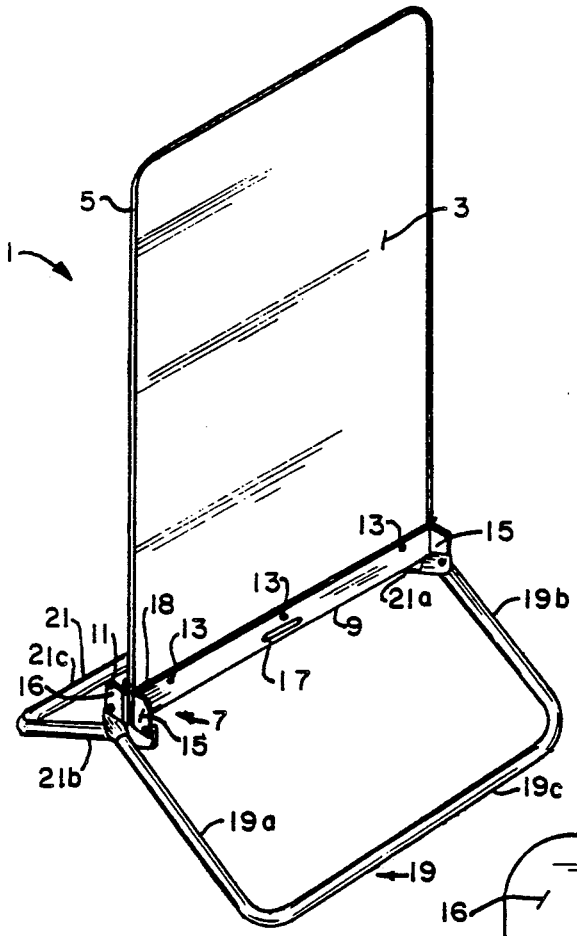
FIG. 1 is a perspective view of a foldable street sign in an open position.
Figure 2:
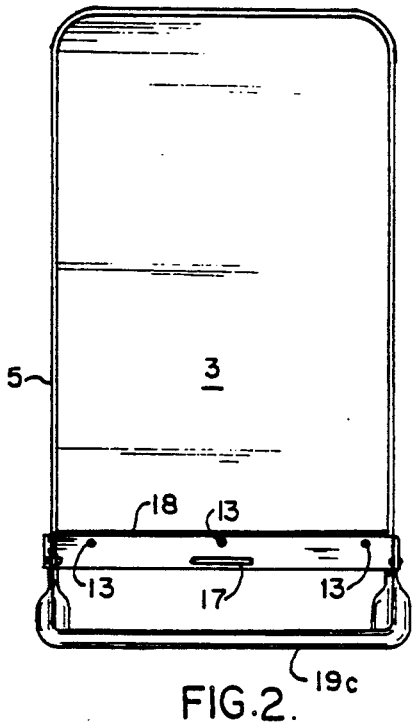
FIG. 2 is an enlarged front view of the sign.
Figure 3:
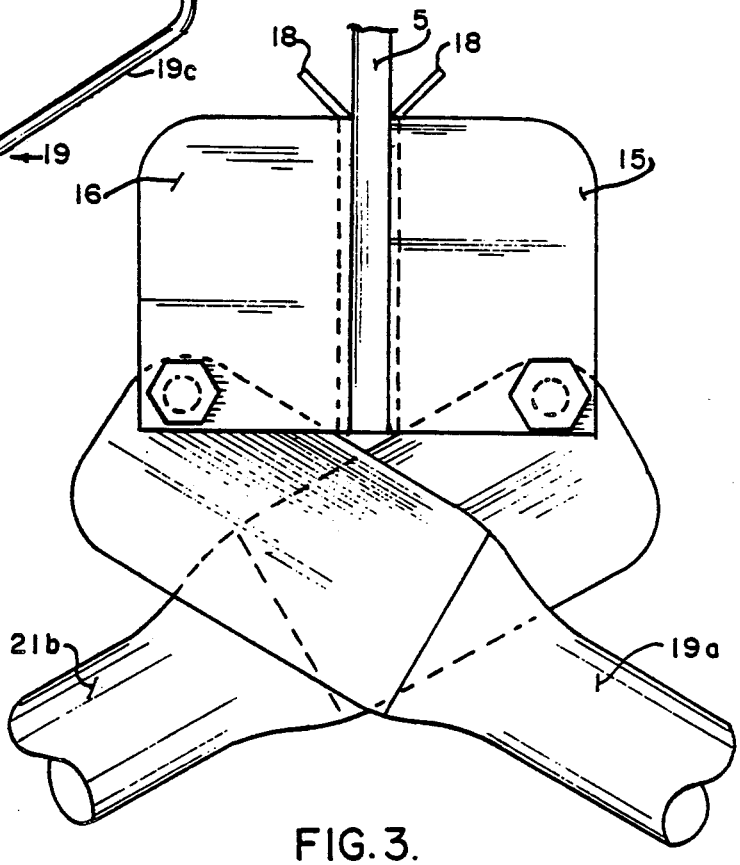
FIG. 3 is an enlarged isometric view showing the connection of legs to one end of the base of the sign.

Referring to the FIGS., reference numeral 1 generally refers to the sign of the present invention. Sign 1 is shown to include a sign panel 3 which may he surrounded by a frame 5. Sign 3 is held by a base assembly 7. Assembly 7 includes a front portion 9 and a rear portion 11, which are similar, although one portion is slightly longer than the other. Portions 9 and 11 are held together by bolts 13 which pass through the sign panel 3 to hold sign panel 3 in assembly 7. Each portion 9 and 11 includes right and left outwardly directed plates 15 and 16, a handle grip slot 17, and an upwardly and outwardly directed lip 18.

Front and back leg members 19 and 21 are connected in a cross over arrangement to plates 15 and 16. Each leg member is generally "U"-shaped and includes a left leg **19*a*, 21*a*, a right leg 19*b*, 21*b* and an integral cross-bar 19*c*, 21*c*. The legs and cross-bar for each portion are preferably formed from a single piece of 1" diameter tubing. Each leg member is pivotally connected to the bar flanges 15 and 16 to allow the sign to be folded for easy transport and storage. The legs are flattened at their upper ends thereof, as at 19***d*, 21*d*, where they are connected to the portion flanges 15 and 16. The legs of front leg member 19 are connected to the flanges 16 of rear portion 11, while the legs of rear leg member 21 are connected to the flanges 15 of the front portion 9. Thus, when the sign is erected during usage, the legs cross-each other, as can be seen in FIG. 1. Although the front leg could be connected to the assembly front portion and the rear leg to the rear portion, this crossing construction is preferred because it adds stability to the sign 1, and furnishes the abuttment necessary to achieve and sustain erection of the sign.

Figure 4:
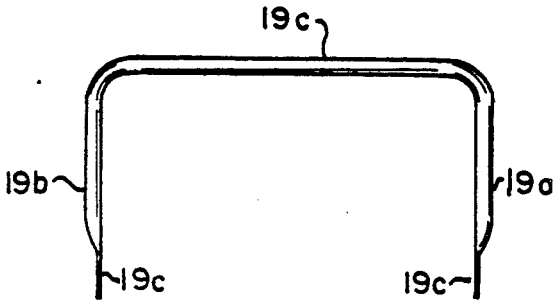
FIG. 4 is a front elevational view of the front leg member of the sign.
Figure 5:
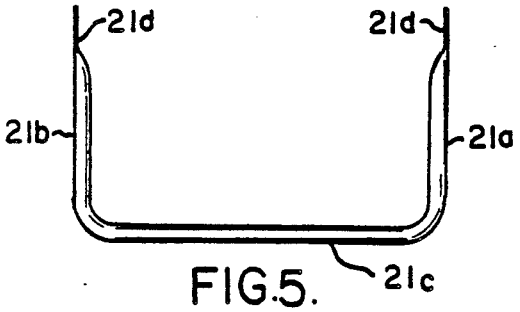
FIG. 5 is a front elevational view of the back leg member of the sign.
Figure 9:
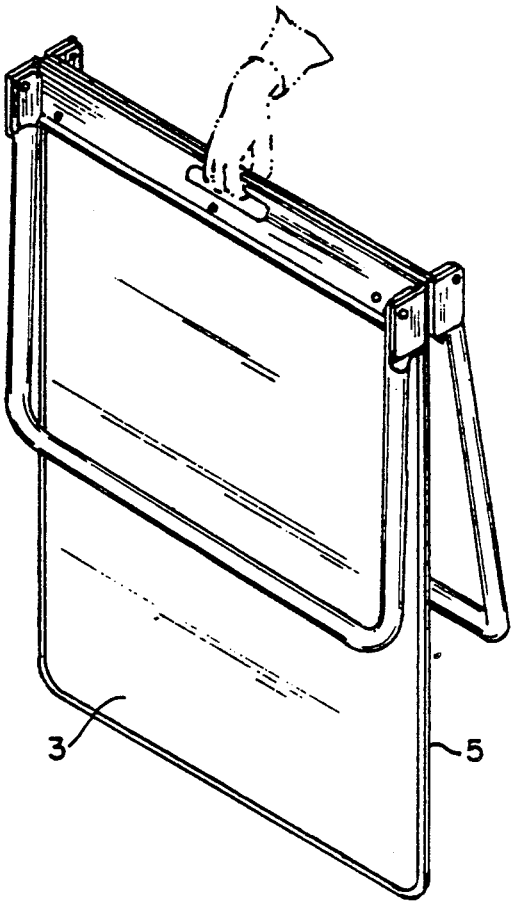
FIG. 9 is an isometric view of the foldable street sign in a closed and carrying position.

Because the legs are U-shaped, one leg must pass through the other during folding and unfolding of the sign. Therefore, one leg member is "inside" of the other and the distance between its legs is shorter. This can be seen in FIGS. 1, 4 and 5. As can he seen in FIG. 1, the rear leg 21 is inside of the front leg 19. By way of example in the preferred embodiment, the rear leg thus has a preferred width of 24" whereas the front leg has a preferred width of 24 ½". The length of the legs, however, are generally the same.

Figure 6:
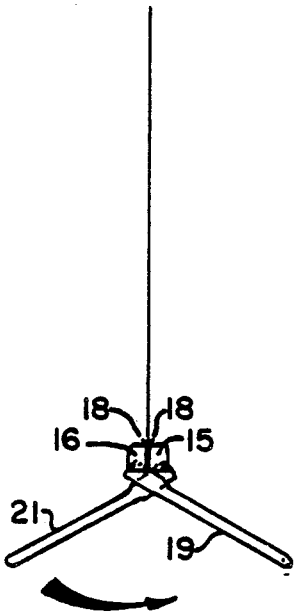
FIGS. 6–8 show the method of unfolding the sign.
Figure 7:
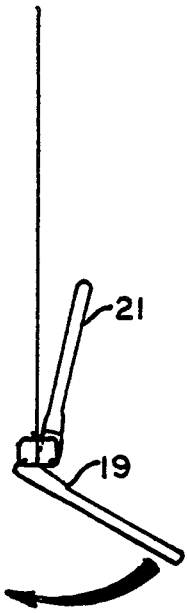
Figure 8:
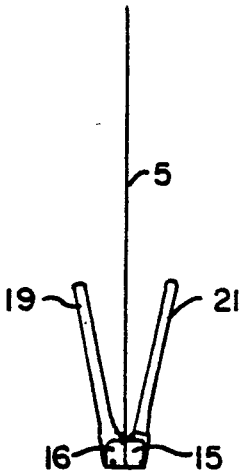

As can be seen in FIGS. 6–8, to fold the sign, the legs are brought toward each other so that the legs uncross. The legs then pivot upward so that the front leg 19 is against the back of the sign and the rear leg is contiguous with the front of the sign. The sign can then be picked up and easily transported through grasping of its grip 17. Further, because the size is now much narrower, in its folded condition, it takes up much less space. It may even be hung from a wall by the hand grip slot 17. The folded sign is very facile to carry. Thus, many more signs may be stored in the same amount of space. In the folded position, lips 18 of base assembly 7 prevent the legs from contacting the sign panel and thus prevent the legs from marring the said panel.

Because the legs are of equal length, if they are brought together beneath the sign panel 3, the cross-bars will obstruct each other, and prevent further pivot and movement of the legs towards their folding direction. Rather, the front (outside) leg must be brought around to the rear of the sign. Because the legs are secured to the flanges 15 and 16, in this position leg 19 will have a longer effective length than leg 21 and leg 21 may be easily passed through leg 19 during folding and unfolding of the sign.

Numerous variations, within the scope of the appended claims, will be apparent to those skilled in the art in light of the foregoing description and accompanying drawings.

Having thus described the invention, what is claimed and desired to be secured by Letters Patent is:

1. A foldable sign including a sign panel, a base assembly said base assembly having a front and a rear portion which receives said sign panel, and leg means pivotally connected to said base assembly, said leg means being pivotal between a first or open position wherein said leg means engage the ground to support the sign and a second or folded position wherein the leg means extend above the base assembly, said leg means including a front leg and a back leg, said front leg being connected to said rear portion of said base assembly, and said back leg being connected to said front portion of said base assembly, said front and back legs crossing beneath said base assembly when the sign is in its open and erected position, said base assembly including forwardly and rearwardly directed flanges to which said legs are connected the forwardly and rearwardly directed flanges are connected respectively to said front and said rear portions, the sign panel being disposed intermediate the front and rear portions, each front and back legs including a right leg and left leg, and a cross bar integrally extending between each of said right and left legs at an end of said legs remote from said base assembly, the right leg and left leg of each of the back and front leg means connecting respectively to the forwardly and rearwardly directed flanges of the base assembly, whereby one of said leg means passing through the other of said leg means when the leg means are manipulated into its open and folded positions.

2. The foldable sign of claim 1 wherein said bas includes an upwardly and outwardly directed lip, said leg means engaging said lip when said sign is in said folded position to prevent marring of said sign panel.

* * * * *

UNITED STATES PATENT AND TRADEMARK OFFICE

CERTIFICATE OF CORRECTION

PATENT NO. : 5,095,642

DATED : March 17, 1992

INVENTOR(S) : Gary P. George; Earl W. Karsten

It is certified that error appears in the above-identified patent and that said Letters Patent is hereby corrected as shown below:

Column 4, claim 2, line 39, change "bas" to ---base---.

Signed and Sealed this

First Day of June, 1993

*Attest:*

*Attesting Officer*

Michael K. Kirk

MICHAEL K. KIRK

*Acting Commissioner of Patents and Trademarks*